United States Patent [19]

Coppens

[11] Patent Number: 4,744,697

[45] Date of Patent: May 17, 1988

[54] INSTALLATION AND REMOVAL VESSEL

[75] Inventor: Anton Coppens, Oegstgeest, Netherlands

[73] Assignee: Heerema Engineering Service BV, Leiden, Netherlands

[21] Appl. No.: 856,745

[22] Filed: Apr. 28, 1986

[30] Foreign Application Priority Data

Apr. 29, 1985 [GB] United Kingdom ..... 8510822
Jun. 5, 1985 [GB] United Kingdom ..... 8514180

[51] Int. Cl.[4] ..... E02B 17/00; B63B 35/00

[52] U.S. Cl. ..... 405/204; 114/265; 405/203; 405/209

[58] Field of Search ..... 405/204, 209, 203, 195, 405/205, 206; 114/264, 265

[56] References Cited

U.S. PATENT DOCUMENTS

| | | | |
|---|---|---|---|
| 2,539,695 | 1/1951 | Moon | 405/204 |
| 2,907,172 | 10/1959 | Crake | 405/209 |
| 3,078,680 | 2/1963 | WePsala | 405/209 |
| 4,167,148 | 9/1979 | Fayren . | |
| 4,242,011 | 12/1980 | Karsan et al. | 405/204 |
| 4,408,930 | 10/1983 | Ninet et al. | 405/204 X |
| 4,556,004 | 12/1985 | Lamy et al. | 405/209 X |

FOREIGN PATENT DOCUMENTS

| | | | |
|---|---|---|---|
| 0001462 | 4/1979 | European Pat. Off . | |
| 8301235 | 4/1983 | World Int. Prop. O. . | |
| 842434 | 7/1960 | United Kingdom . | |
| 1017944 | 1/1966 | United Kingdom . | |
| 1220689 | 1/1971 | United Kingdom | 405/204 |
| 1454113 | 10/1976 | United Kingdom . | |
| 1511829 | 5/1978 | United Kingdom . | |
| 2008652 A | 6/1979 | United Kingdom . | |
| 2021665 A | 12/1979 | United Kingdom . | |
| 2023697 A | 1/1980 | United Kingdom . | |
| 2165188 A | 4/1986 | United Kingdom . | |
| 2168293 A | 6/1986 | United Kingdom . | |

*Primary Examiner*—Dennis L. Taylor
*Attorney, Agent, or Firm*—Fulwider, Patton, Rieber, Lee & Utecht

[57] ABSTRACT

A vessel (10) is provided for installing or removing a module (16) on or from a support structure (30) erected in a body of water. The vessel is able to suspend the module over the support structure by cranes (14, 15), enabling installation or removal of the module to be accomplished while the module is being suspended.

20 Claims, 8 Drawing Sheets

INSTALLATION AND REMOVAL VESSEL

This invention relates to a vessel for installing or removing a module on or from a support structure in a body of water and to a method of module installation or removal on or from such a support structure.

Installation vessels experience wave-induced motion. This motion can become unacceptably high in adverse weather conditions. To enable installation or removal of a module to be accomplished, therefore, a sufficiently clear "weather window" is needed. This problem is of course more acute when the support structure is located offshore. Some advantage is to be gained by using a vessel which is semi-submersible as this is less prone to wave-induced motion. There is always the danger, however, of damage to the support structure by collision with the vessel. Various proposals have been put forward to overcome this problem. These include using some form of shock absorbing device to steady the vessel relative to the support structure. However, support structures are often not designed to withstand forces of this magnitude. Furthermore, forces from the wave-induced motion of the vessel in these proposals can be transmitted to the support structure through the module at the time of its transfer from the vessel to the support structure or vice versa.

The present invention provides a vessel for installing or removing a module on or from a support structure in a body of water, the vessel comprising:

deck support means to support a module at a level below the level at which the module lies on the support structure:

spaced apart suspending means on opposed sides of the module to suspend the module in a position above its position on the deck support means: and means to raise the module to a raised position above the level of the support structure, the vessel being shaped so that it can be positioned with the suspended module in its raised position and the suspending means one on each side of the support structure so that the module can be lowered into position on the support structure and the vessel then withdrawn, or alternatively the module raised up from the support structure and taken away by the vessel.

The means for raising the module may be by deballasting the vessel and/or by lifting power in the suspending means.

In one preferred embodiment the vessel has an opening therein and the vessel is positionable with respect to the support structure by bringing up the vessel so that the support structure is located substantially within the opening, the spaced apart suspending means being provided one to each side of the opening.

In another preferred embodiment the support structure has a gap therein which is wide enough to receive at least a part of the vessel and the vessel is positionable with respect to the support structure by bringing up said part of the vessel into the gap, the suspending means being provided one to each end of said part of the vessel and one said suspending means being collapsible to allow for exit and entry of the vessel from and into the gap when the module is in position on the support structure.

The invention also provides a method of installing or removing a module on or from a support structure in a body of water, comprising:

providing a vessel with spaced apart suspending means to suspend a module on opposed sides of the module and means to raise the module to a raised position above the level of the support structure:

the method including the steps of positioning the vessel with the suspended module in its raised position and the suspending means on each side of the support structure, and lowering the module into position on the support structure and withdrawing the vessel, or alternatively raising up the module from the support structure and taking the module away with the vessel.

By way of example, some embodiments of the invention will now be described with reference to the accompanying drawings, in which.

The vessels to be described are for installing or removing a module on or from a support structure erected in a body of water. The term module as used herein includes deck or platform structures or integral units thereof, as well as other kinds of superstructure for inshore or offshore installations, such as mooring station units or the like. The support structure will usually be a tower construction rising above the surface of the water and resting on foundations on the sea bed. The support structure may have a single platform jacket on which the module is to be installed, as in the FIG. 1 example. Alternatively, the support structure may have two or more spaced apart platform jackets, as in the FIG. 5 example.

Figure 1:
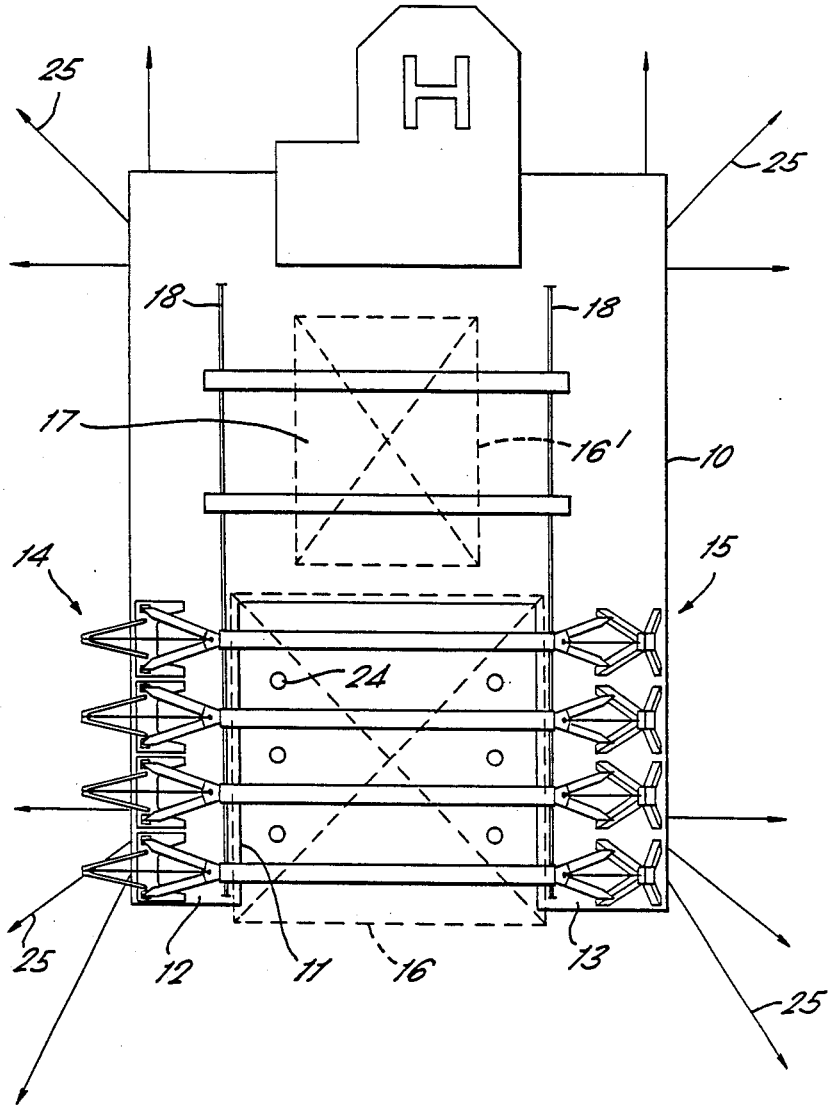
FIG. 1 is a plan view of one vessel according to the invention.

The module installation and removal vessel 10 seen in FIG. 1 is U-shaped, having an opening 11 at one end defined between port and starboard sides 12, 13. The vessel 10 in this case is for installing or removing a module on or from a support structure having one platform jacket. The U-shape of the vessel enables it to be brought up into position relative to the support structure so that the platform jacket of the structure is located preferably fully within the opening 11.

Figure 2:
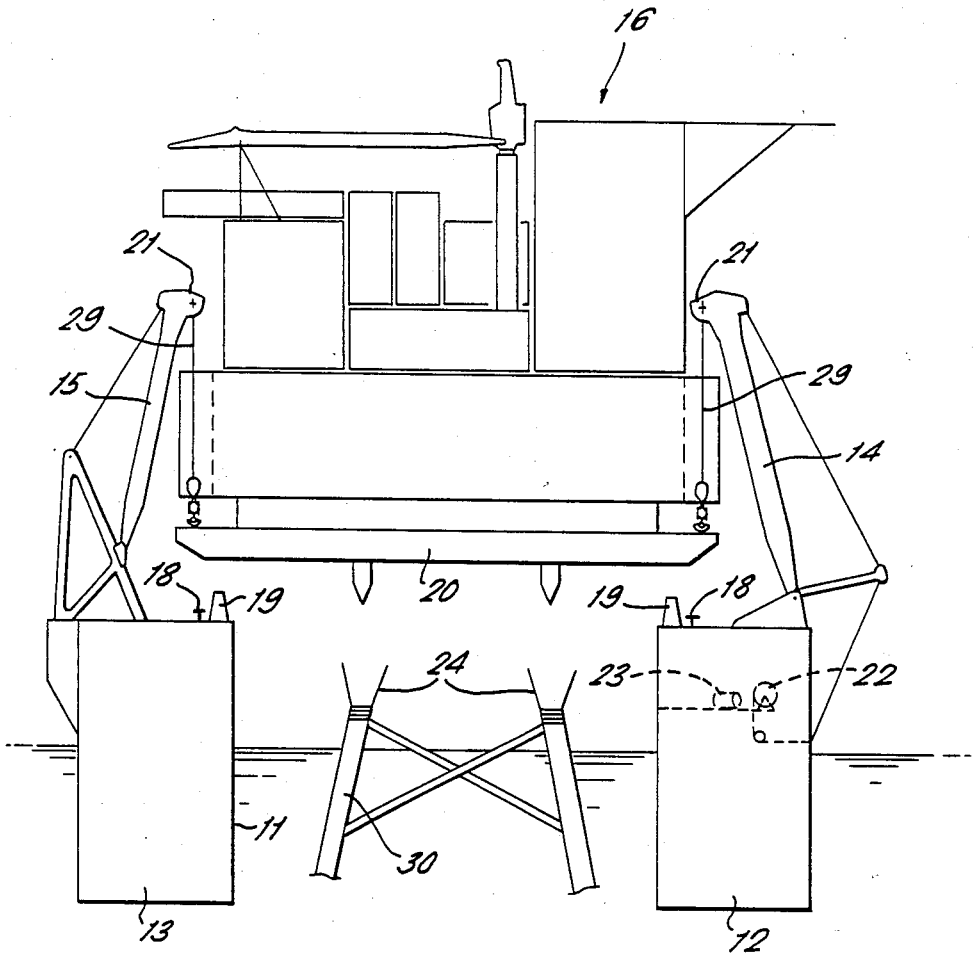
FIG. 2 is a sectional view through the vessel carrying, in this case, a deck module.

On each side 12, 13 of the vessel 10 there is provided a bank of cranes 14, 15. Two alternative types of crane are depicted in FIGS. 1 and 2. The cranes 14, 15 enable a module 16 to be suspended over the opening 11, as shown in FIG. 2, so that it hangs clear of the vessel 10 above the surface of the water.

Preferably, there is a control means to ensure that the cranes 14, 15 operate in unison so that the module 16 is kept level, which can be fully automatic. In FIG. 2, the module 16 shown is an integrated deck structure which is to be fitted to the platform jacket 30 of an offshore support structure. The module is seen to have connection means on its underside in the form of stabbing pins 31 which are engageable in guides 24 on the platform jacket 30 of the support structure.

Prior to installation, the module 16 can be carried on the deck 17 of the vessel 10. Rails 18 are provided on top of the vessel 10 to enable the module 16 to be slid, skidded or wheeled along the rails 18 and into position over the opening 11 ready for installation. Blocks 19 are provided for supporting the module 16 over the opening while the cranes 14, 15 are hooked up to the module support frame 20, which in this case is integral with the module 16 itself, so that the module is supported from underneath. Additional girders may be required if the module support frame 20 is not itself strong enough, and the girders themselves may be braced by transverse connecting beams. The rail arrangement on deck avoids the need to equip the vessel 10 with slewing cranes for moving the module into position.

Because the boom tip 21 of the cranes 14, 15 can be quite close to the module support frame 20, only relatively small cranes are needed. The cranes 14, 15 may be equipped with cables or tension rods, and can have winches 22 with their own electrical power generators 23, but this is not essential. The cranes 14, 15 may also incorporate a heave compensating device to keep steady the vertical position of the module 16 relative to the support structure during installation or removal.

Figure 3:
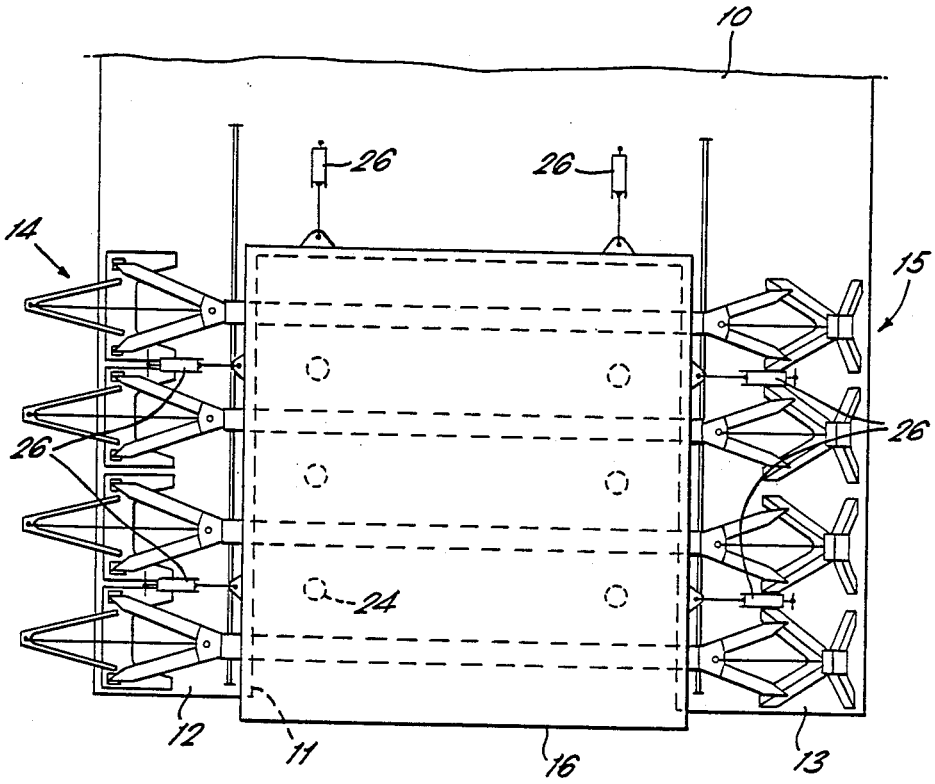
FIG. 3 is a plan view of the vessel in more detail, showing module positioning units.

For installation, the vessel 10 is brought up into position with respect to the platform jacket 30 of the support structure so that the platform jacket 30 with its guides 24 is located within the opening 11, as shown in FIG. 3. The vessel 10 is held in this position using a number of anchoring lines 25 which are tied to the sea bed, as shown in FIG. 1. A nominal clearance is left around the support structure in the opening 11 to allow for a limited amount of wave-induced horizontal movement of the vessel 10. The module 16 can now be lowered whilst being suspended from the vessel 10 onto the platform jacket 30 of the support structure, engaging the stabbing pins 31 of the module 16 in the guides 24. The position of the module 16 relative to the support structure may be kept steady despite any wave-induced motion of the vessel 10 by means of hydraulic jacks 26, as shown in FIG. 3. Of course, other means such as by hand lines or by cable and winch could equally well be used. The position of the module 16 relative to the guides 24 may be monitored, for example by means of laser, and means such as by computer may be used to operate the module positioning units automatically to keep the module position steady during installation. Naturally, the vessel 10 could equally well be used for the removal of a module 16 from a support structure, in which case the above described steps are essentially the same but in reverse.

Figure 4:
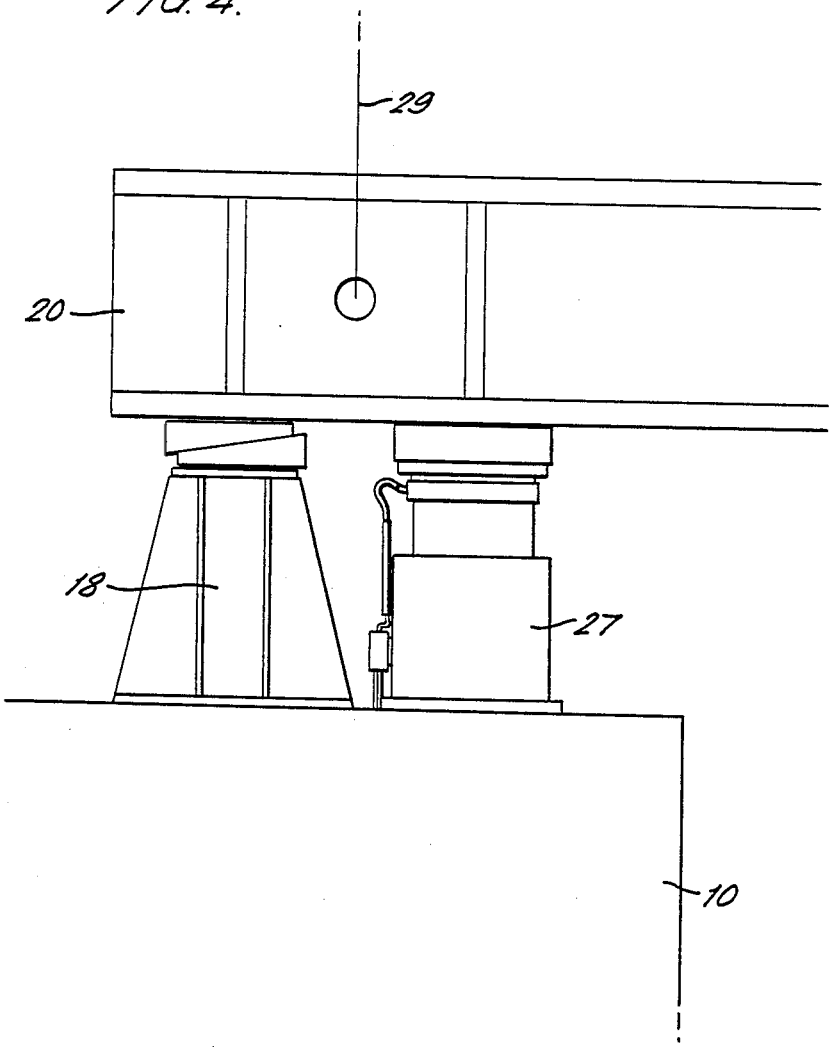
FIG. 4 is a side view of the vessel in more detail, showing a module jacking unit.

In FIG. 4 it will be seen that the cranes 14, 15 themselves do not have to have a lifting capability: the module 16 can be lifted initially by means of hydraulic jacks 27, supported on blocks 18 and hooked up to the crane cables 29. The cranes 14, 15 may simply be required to suspend the module 16, in which case the module could be lowered into position on the support structure by ballasting the vessel 10.

Of course, many different types of crane and combinations of types could be used, and the location of the cranes around the opening 11 in the vessel 10 could also be varied. The module 16 may incorporate lifting eyes for hooking up to the cranes 14, 15. Instead of the opening being defined by a U-shaped vessel, the vessel could of course be some other suitable shape, such as T-shape or possibly W-shape, and it may have more than a single opening 11.

The vessel 10 may be a semi-submersible vessel and there may be cross-bracings which link together two or more of the cranes 14, 15. This makes controlling the cranes 14, 15 in unison easier.

The vessel 10 may be a conventional floating barge or ship.

Figure 5:
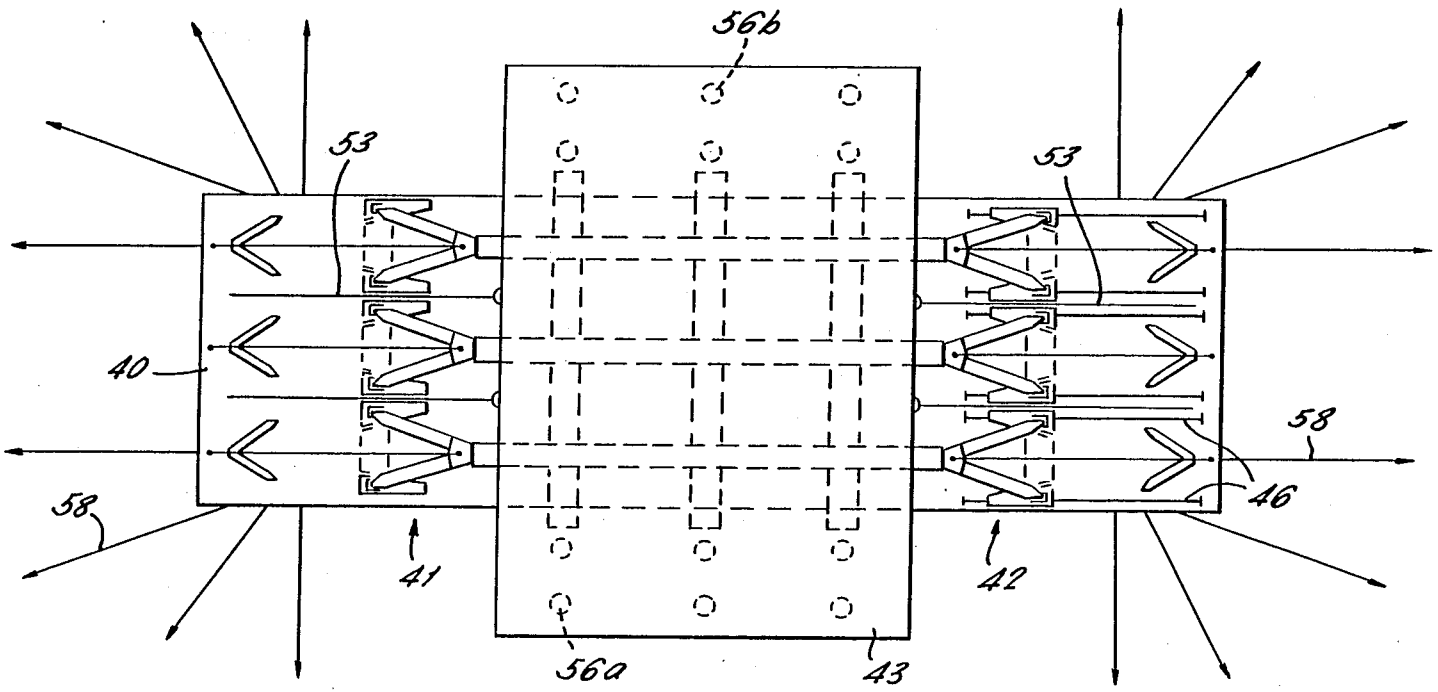
FIG. 5 is a plan view of another vessel according to the invention.
Figure 6:
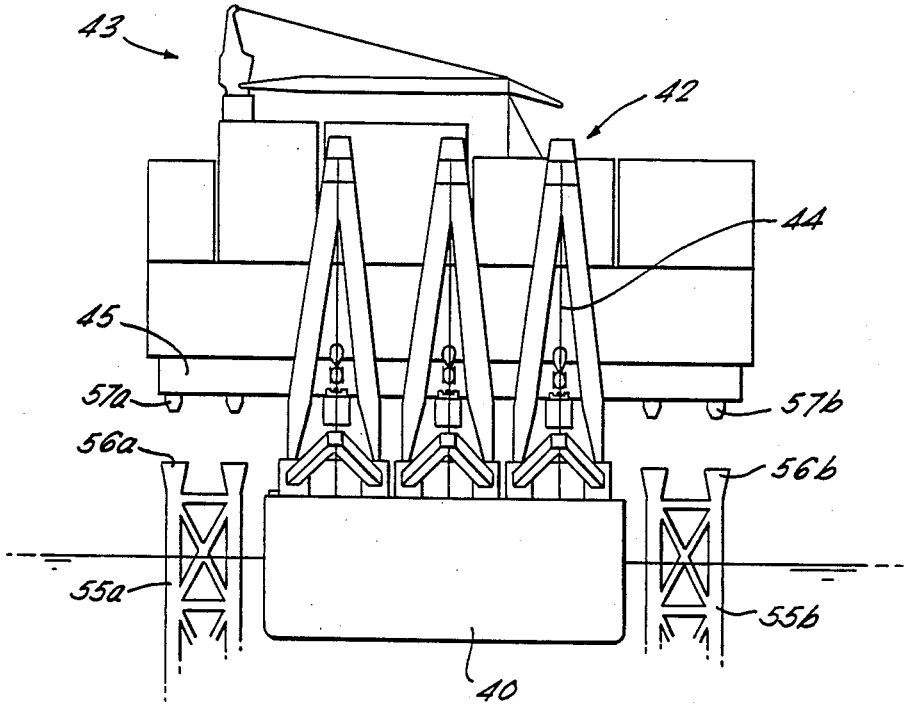
FIG. 6 is an end elevational view of the vessel of FIG. 5 carrying, in this case, a deck module.
Figure 7:
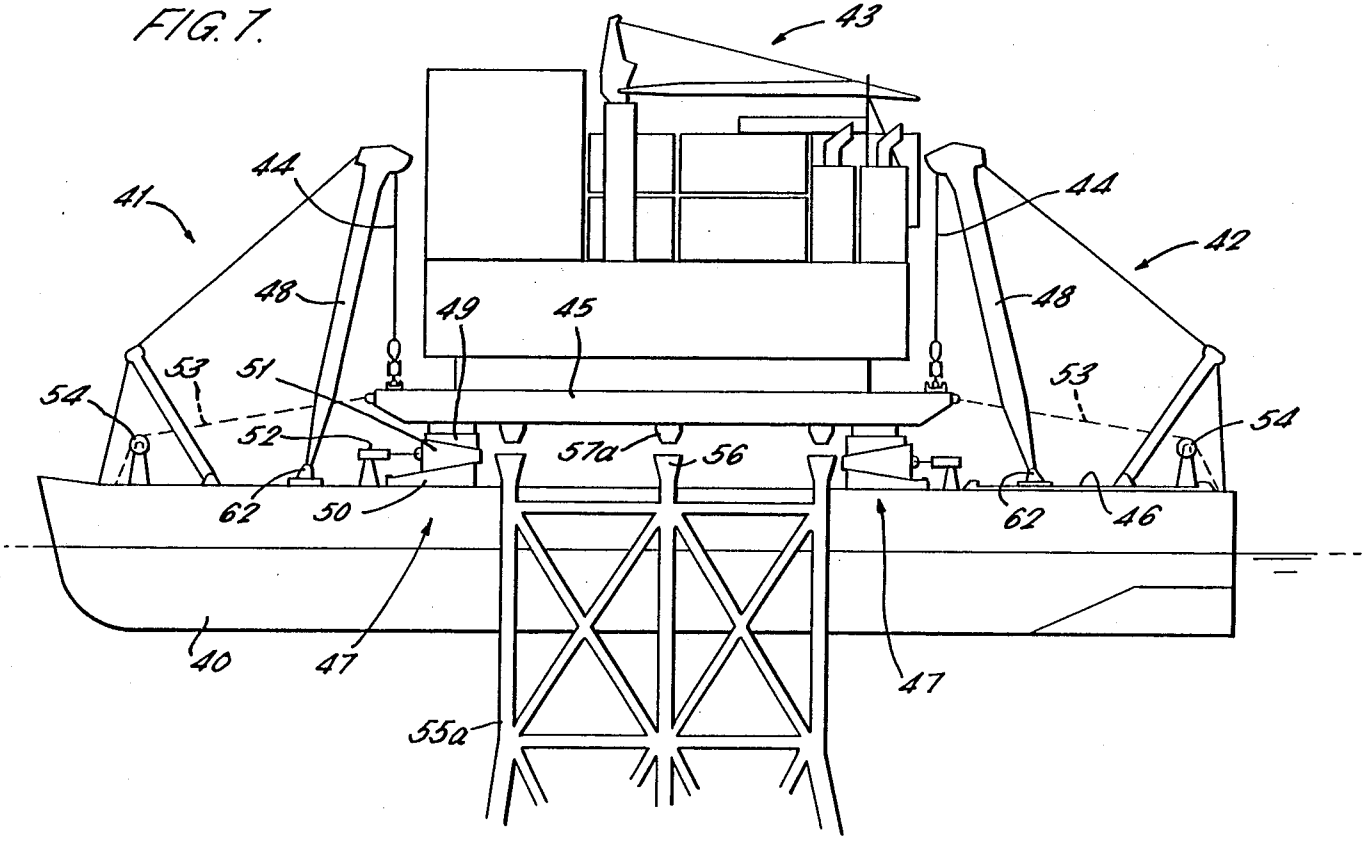
FIG. 7 is a side elevational view of the vessel shown in FIG. 6.

In FIGS. 5, 6 and 7 there is shown an alternative vessel 40 incorporating two banks of cranes 41, 42 fore and aft of the vessel. The cranes 41, 42 are able to suspend a module 43 over the vessel 40 by means of crane cables 44, which may be chains, lines, ropes etc. The crane cables 44 support the module 43 from below its centre of gravity on a support frame 45. The support frame 45 may be an integral part of the module 43, as in FIG. 7 where the module is an integrated deck, or a separate structure for carrying a module. The cranes 41, 42 need not necessarily have any lifting or lowering capability themselves, and may simply comprise booms 48 from which to hang the module. For reasons that will become clearer later, at least one of the banks of cranes is collapsible.

On the deck of the vessel 40 shown in FIG. 7 there are provided blocks 47. These blocks 47 support the module 43 on the deck of the vessel 40 while it is in transit. The module 43 may be initially loaded onto the blocks 47 such as by skidding it from a quay or by deballasting the vessel underneath the module while it rests over the water on suitable supports. The blocks 47 here are in the form of driving wedge arrangements comprising upper and lower taper blocks 49, 50 with a wedge 51 sandwiched in between. The wedges 51 can be withdrawn from between the taper blocks 49, 50 by means of hydraulic jacks 52 or other means to reduce the height of the blocks 47 and leave the module 43 suspended from the crane cables 44. Of course, other lowering means could be used. The horizontal position of the module 43 relative to the vessel 40 can be adjusted while the module is being suspended by means of cables 53 and winches 54. Of course, other means such as by tugger lines or hydraulic jacks could alternatively be used.

As can be seen from FIG. 6, the module 43 is wider than the vessel 40 here, so that either end of the module overhangs the vessel, and is to be supported on a pair of spaced apart platform jackets **55*a*, 55*b* of the support structure. The vessel 40 is able to float in between the two platform jackets 55*a*, 55*b*. There may of course be more than two platform jackets 55*a*, 55*b*. The platform jackets 55*a*, 55*b* have guides 56*a*, 56*b* to receive locating pins 57*a* 57*b* on the underneath of the module support frame 45**.

Installation of the module 43 is seen taking place in FIG. 5. The vessel 40 has been brought into position between the platform jackets **55*a*, 55*b* using mooring lines 58 or other means and anchored by the mooring lines 58. The blocks 47 have been lowered or removed so that the module 43 is now being suspended by the cranes 41, 42. Now, the module 43 is being lowered towards the platform jackets 55*a*, 55*b* so that the locating pins 57*a*, 57*b* engage the guides 56*a*, 56*b*. During this operation, there may well be horizontal motions induced in the vessel 40 by action of wind, waves or currents. Preferably, therefore, the vessel 40 incorporates means for monitoring the horizontal position of the module 43 relative to the platform jackets 55*a*, 55*b*. Such monitoring means may, for example, be by laser. The horizontal position relative to the platform jackets 55*a*, 55*b* of the module 43 is preferably adjusted automatically in response to the module position monitor, and this may be done by computer. In the vessel shown in FIGS. 5, 6 and 7, the module horizontal position is adjusted by cables 53 and winches 54, as described above. The lowering of the module 43 onto the platform jackets 55***a*, 55*b* may be achieved by ballasting the vessel 40. In this embodiment, however, the module 43 can be lowered by using the cranes 41, 42 instead of or in addition to ballasting the vessel. The cranes 41, 42 comprise main booms 48 attached to pivotal mounts 52, one of which is slidable along rails 46 on the deck of the vessel 40. After installation of the module 43, the bank of cranes 42 is collapsed down onto the deck of the vessel in order that the vessel can be withdrawn from between the platform jackets 55*a*, 55*b*. Removal of the module 43 from the platform jackets 55*a*, 55*b* involves the same operations but of course these are in reverse order. In addition to horizontal position control, there is preferably also means for adjusting the vertical position of the module 43 relative to the vessel 40 in order to be able to compensate for heave motions of the vessel. Naturally, there is preferably also some means to provide synchronous operation of the cranes 41, 42 so that the module 43 will remain as level as possible.

Figure 8:
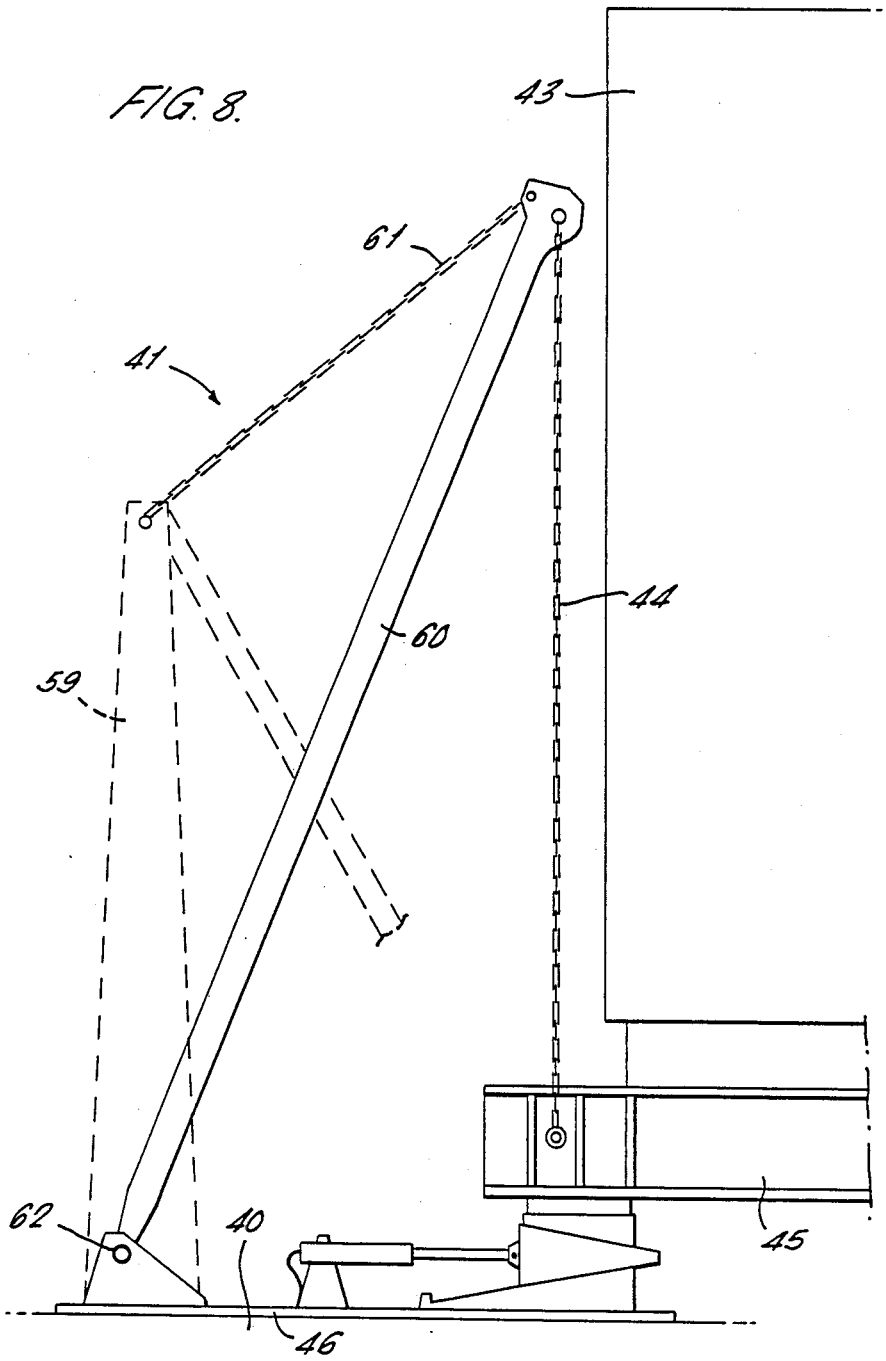
FIG. 8 is a detail showing a module suspension system of the vessel.

From FIG. 8, which shows the crane system 41 in more detail, it will be clear that many different crane arrangements are possible. For example, the cranes may have a support member 59 which is tied to the main boom 60 by cable, chain, line or frame structure 61 etc. If one bank of cranes is collapsible, the other cranes may be fixed structures. The crane cables 44 may incorporate hydraulic units or springs so that they have additional elasticity, as may additionally or alternatively member 61. Conventionally, modules have been lifted by lugs or eyes on the top of the module. This means that the module itself will often require strengthening so that it can support its own weight, and it also means that the cranes need long booms. Here, the module is lifted from below its centre of gravity, and only relative short crane booms are necessary. The module is preferably lifted by its support frame.

I claim:

1. A vessel for use in installing or removing a module on or from a support structure extending upwardly in a body of water to a level near to or above the surface of the water, which vessel comprises:

suspending means for carrying a module, which suspending means includes spaced-apart downwardly hanging cables and means for connecting the lower ends of the cables to opposite sides of the module to support the module in position vertically with respect to the vessel while allowing the module freedom to move horizontally relative to the vessel, means to raise and lower the module between the level at which the module rests on the support structure and a raised position above said level, and horizontal force-applying means operatively interposed between the module and the vessel for applying horizontal force to the module to thereby enable the horizontal position of the module relative to the vessel to be altered while the module is being carried by said cables, so as to thereby align the module relative to the support structure while the module is installed upon or removed from the support structure.

2. A vessel as claimed in claim 1 wherein the vessel includes means for monitoring the horizontal position of the module relative to the support structure during installation or removal of the module.

3. A vessel as claimed in claim 1 wherein the vessel includes means for adjusting the vertical position of the module relative to the vessel to allow compensation for wave-induced heave motions of the vessel.

4. A vessel as claimed in claim 1 wherein the means to raise and lower the module includes means for deballasting and ballasting the vessel.

5. A vessel as claimed in claim 1 wherein the means to raise and lower the module includes means for winding up or paying out the cables.

6. A vessel as claimed in claim 1 wherein the cables are connected to the module at a level below the center of gravity of the module.

7. A vessel as claimed in claim 1 wherein the suspending means further include spaced apart cranes from which the cables hang downwardly.

8. A vessel as claimed in claim 2 wherein the vessel includes means for operating said horizontal force applying means in response to said means for monitoring the horizontal position of the module while the module is being installed or removed from said support structure.

9. A vessel as claimed in claim 7 wherein the vessel has an opening therein with the support structure being located substantially within the opening, and the spaced apart cranes are disposed on opposite sides of the opening.

10. A vessel as claimed in claim 7 wherein the support structure is formed with a gap which is wide enough to receive at least a part of the vessel and the vessel is positionable with respect to the support structure by bringing up said part of the vessel into the gap, the spaced apart cranes being provided on each end of said part of the vessel, and one said cranes being collapsible to allow for exit and entry of the vessel from and into the gap when the module is in position on the support structure.

11. A vessel for use in installing or removing a module on or from a support structure extending upwardly in a body of water to a level near to or above the surface of the water, which vessel comprises:

suspending means for carrying a module, which suspending means includes spaced apart cranes from which cables hang downwardly and means for connecting the lower ends of the cables to opposite sides of the module to support the module in position vertically with respect to the vessel while allowing the module freedom to move horizontally relative to the vessel, means to raise and lower the module between the level at which the module rests on the support structure and a raised position above the said level, and horizontal force-applying means operatively interposed between the module and the vessel for applying horizontal force to the module to enable the horizontal position of the module relative to the vessel to be altered while the module is being carried by said cables so as to thereby align the module relative to the support structure while the module is being installed upon or removed from the support structure.

12. A vessel as claimed in claim 11 wherein the vessel includes means for monitoring the horizontal position of the module relative to the support structure during installation or removal of the module.

13. A vessel as claimed in claim 12 wherein the vessel includes means for operating said horizontal force-applying means for applying horizontal force to the module in response to said means for monitoring the horizontal position of the module while the module is being carried by said cables.

14. A vessel as claimed in claim 13 wherein the vessel includes means for adjusting the vertical position of the module relative to the vessel to allow compensation for wave-induced heave motions of the vessel.

15. A vessel as claimed in claim 14 wherein the means to raise and lower the module includes means for deballasting and ballasting the vessel.

16. A vessel as claimed in claim 15 wherein the means to raise and lower the module comprises means for winding up or paying out said cables.

17. A vessel as claimed in claim 16 wherein said cables are connected to the module at a level below the center of gravity of the module.

18. A method of installing or removing a module on or from a support structure extending upwardly in a body of water to a level near to or above the surface of the water, which method comprises:

providing a vessel with downbwardly hanging spaced apart cables and means for connecting the lower ends of the cables to opposite sides of a module to support the module in position vertically with respect to the vessel while allowing the module freedom to move horizontally relative to the vessel;

providing means for raising and lowering the module between the level at which the module rests on the support structure and a raised position above said level;

providing horizontal force-applying means operatively interposed between the module and the vessel for applying horizontal force to the module while the module is being carried by said cables;

bringing the vessel into position relative to the support structure;

holding the vessel in position with clearance between the vessel and the support structure with no force-transmitting connection therebetween; and installing or removing the module using said means for raising and lowering the module, with the vessel held in said position and the module carried by said cables, while maintaining the module in the proper horizontal position relative to the support structure using said horizontal force-applying means to align the module relative to the support structure.

19. A method as claimed in claim 18 wherein said step of holding the vessel in position relative to the support structure includes using tension lines to anchorages remote from the support structure.

20. A method as claimed in claim 19 wherein said tension lines are used in said step of bringing the vessel into said position relative to the support structure.

* * * * *